United States Patent [19]

Jenner et al.

[11] 4,242,802

[45] Jan. 6, 1981

[54] DRAWING PATTERN FOR THE HUMAN FORM

[75] Inventors: Rolf-Dieter Jenner, Tamm; Dieter Schäfer; Wolfgang O. Bauer, both of Leonberg, all of Fed. Rep. of Germany

[73] Assignee: Robert Bosch GmbH, Stuttgart, Fed. Rep. of Germany

[21] Appl. No.: 40,078

[22] Filed: May 17, 1979

[30] Foreign Application Priority Data

May 20, 1978 [DE] Fed. Rep. of Germany ..... 2822151

[51] Int. Cl.[3] ..... B41N 1/24

[52] U.S. Cl. ..... 33/174 B

[58] Field of Search ..... 33/174 B, 174 G

[56] References Cited

U.S. PATENT DOCUMENTS

| | | | |
|---|---|---|---|
| 1,974,442 | 9/1934 | Baldwin | 33/174 B |
| 4,026,041 | 5/1977 | Kennedy | 33/174 B |

*Primary Examiner*—Willis Little

*Attorney, Agent, or Firm*—Flynn & Frishauf

[57] ABSTRACT

A stencil plate provides the outline of front, side and top views of a normalized human body in outline form, pivot holes corresponding to each joint and additional holes indicating the natural range of swing about each joint, particularly in the top view, some showing foreshortening as the result of holding the arm at an inclination to the horizontal plane provided. By swinging the stencil plate at a pivot point between the stages of drawing the outline, various body attitudes may be drawn. With such stencils, the layout of counters, consoles, equipment, etc., at a workplace may be suited to the operating personnel.

12 Claims, 1 Drawing Figure

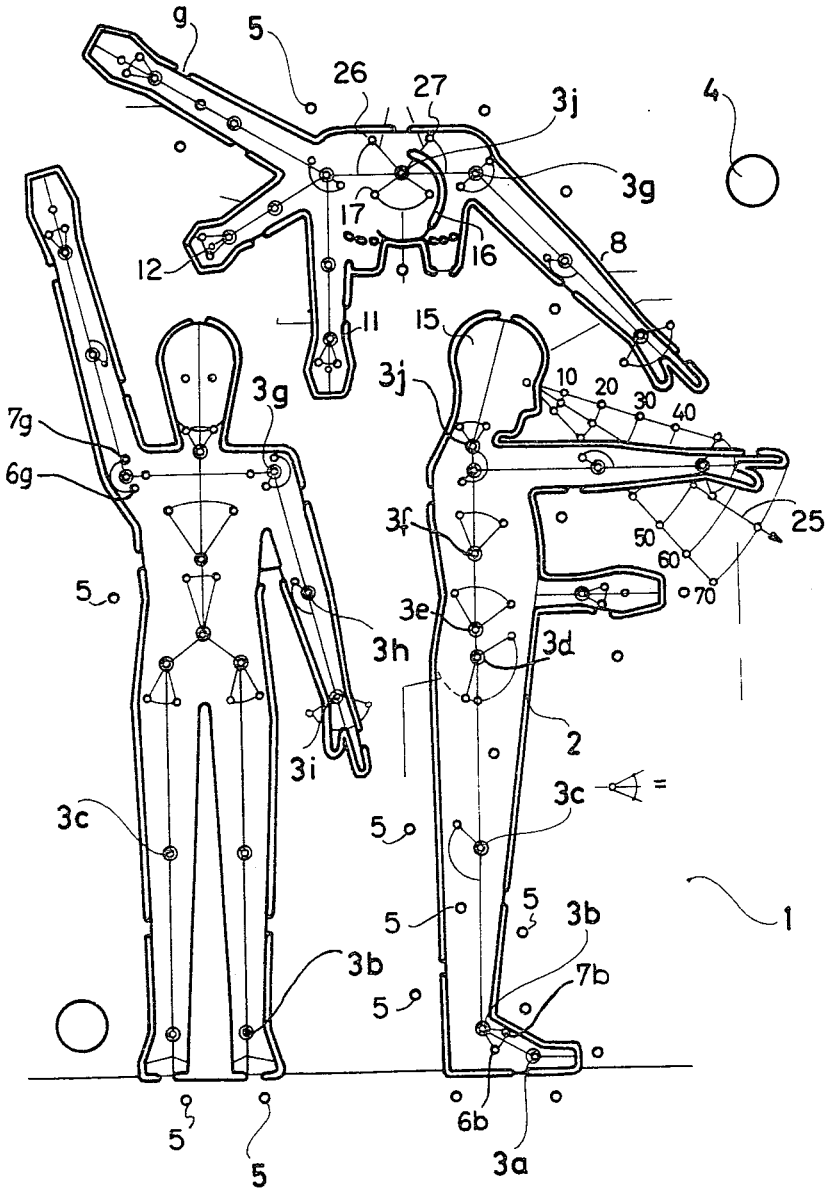
g
5
26
27
3j
4
3g
17
16
8
12
11
15
3j
10
20
30
40
7g
3g
6g
3f
25
50
60
70
5
3e
3h
3d
2
3i
3c
3c
5
5
5
3b
1
3b
7b
5
6b
5
5
3a

DRAWING PATTERN FOR THE HUMAN FORM

This invention relates to stencil plates such are used as drafting and design aids, and particularly to a stencil plate for showing the position of the outline of a human body normalized to a particular scale, in a variety of attitudes, particularly for use in the design of furnishings and equipment, in layouts of the same in a manner most compatible with the physical characteristics of the average user thereof.

The problem of designing technical objects to fit human dimensions, sometimes known as the "man-machine interface," is described in an article by P. Jenik, entitled "*Maschinen menschlich konstruiert*," published in Volume 78, (1972), by Maschinen markt-Industriejournal, No. 5, pp. 887 and following, relating particularly to work places. The problem there discussed basically is that of being sure at the stage of design, to suit the dimensions of the machine or of the work place, console, operating position or the like, or the arrangements of controls and operating devices as well as possible to a representative magnitude range of operating personnel.

The literature on this subject provides a good deal of body measurement information, mostly in tabular form. The practical application of such data is troublesome and time consuming in equipment and facility design. Furthermore, the separate measurement magnitudes of average body dimensions and the values derived therefrom, such as the optimum table or seat levels relative to the floor are provided without functional correlation, so that these do not provide the designer, manufacturer, or builder an adequate basis for efficiently arriving at a suitable spatial concept if, for example, a work space is to be designed for a combined set of sequential movements involving different attitudes and evolutions of the arms.

Patterns and stencils for drawing and desing assistance, so far as they have been heretofore available for the human form, have been essentially the equivalent of cut-out silhouettes provided as pieces of synthetic plastic, usually transparent.

It is the object of the present invention to provide a stencil plate for the human form which, in the design phase of supply of equipment, furnishing and facilities the anatomic and anthropometric data of human beings can simply be taken account of in the provision of workplaces and portions of equipment requiring manipulation or other operation by operating personnel. In particular, such a stencil should be suitable for representing human form in various body attitudes in stepless variation, likewise the extension of limbs and the use of joints, taking account in each case of the maximum range of flexure normally available at the joint.

SUMMARY OF THE INVENTION

Briefly, a stencil plate provides one or more basic outline views of the human body, with the outlines cut in slots through the plate, except for interruptions necessary to maintain in position areas enclosed by the outline, and pivot holes are provided at locations corresponding to the joints so that different attitudes of the body produced by flexure and joints can be illustrated by rotating the stencil plate about a pivot hole between stages of tracing the body outline through the stencil. Preferably, additional holes are provided near the pivot holes for showing the maximum extent of deviation at the joint, in the case of a normal body, with respect to the position at the joint fixed in the stencil.

In the preferred form of the stencil a front view, a side view, and a top view of a typical human body are shown in outline, and in the front and side view at least one additional pivot point is provided by which the effect of flexure of the spine may be shown. In the front and side view, two arms are shown in different positions, and in the top view not only are the two arms shown in different positions, but one of the arms is shown in outline in several different positions, including positions at various angles to the horizontal plane. In all of the views, an arm position shows a side view of a hand and one of a front or back view of a hand with a perforation conveniently indicating the middle of the hand.

Preferably, the stencil plate has small facing knobs here and there to maintain spacing between the stencil plate and an underlying flat surface, such as a drawing, and these may be provided on both sides of the plate, so that the plate may be used with either side up.

The advantages of the invention are that practically all positions likely to be taken in work operations can be illustrated by simple use of a single stencil plate although a series of plates may be necessary to indicate the differences for the cases of the largest, average, and smallest normal men and the largest, average, and smallest normal women. In each of the views shown in the stencil plate, the possible positions of the extremities are all correlated so that, for purposes of design, the ease and efficiency of a machine operator's work can be estimated and dangers to life and limb avoided. The stencil plate can also carry lines and angles of sight and descriptive materials such as dimension ranges desired.

The indication of ranges of particular movement at the various joints assists in the avoidance of unnatural body positions in the operation of machinery.

THE DRAWING

The single FIGURE of the drawing shows an illustrative embodiment of the stencil plate according to the invention, in this case illustrating the proportions of the typical "largest" man.

DETAILED DESCRIPTION OF THE DRAWING

The left-hand portion of the drawing illustrates the front or back outline view, the right-hand portion is a side view, while the upper part shows a top view. Since the outline view is the same for front or back, this outline view can be defined without the use of alternative expressions by referring to it as a view perpendicular to a side view.

The illustrated stencil plate is a thin rectangular plate 1 of transparent, preferably colored, synthetic resin plastic, in which outlines are defined by successive slots 2 of a shape provided by the outline to be shown. The line slots 2 are interrupted by short intermediate bridges in order to hold in place the portions of the stencil within the outline, particularly in the case of the limbs and extremities.

These interior portions of the stencil indicate essential joints by pivot holes 3 which are listed below beginning with the bottom of the FIGURE, with mention of the reference symbol:

3*a*—foot tip joint
3*b*—ankle joint
3*c*—knee joint
3*d*—hip joint 3*e*—loin joint
3*f*—a fictitious breast joint (representative of flexure of spine)
3*g*—shoulder joint
3*h*—elbow joint
3*i*—wrist joint
3*j*—simplified neck joint The pivot holes 3 are located in each case on the axis of a limb or a body part that turns about the joint. Placing a pencil point, or compass point, or the like in the hole will allow rotation of the outline of the limb or body part in question to the desired angle of rotation. Then, in the new position reached by this rotation, the outline of the limb in the desired position may be drawn through the corresponding slots.

Additional holes 6, 7 give the range of maximum swing about a joint so that this may be marked on a drawing without removing the stencil, with the result that after subsequent rotation of the stencil, it can be determined in a simple manner that the maximum range swing relative to the original position has not been exceeded.

The larger holes 4 furnish convenient fingergrips for rotating the stencil when the stencil is held fixed at a pivot point by a pencil or the like through a hole 3 representing a particular joint.

Small knobs 5 are provided from the top and bottom of the stencil to be used, with either stencil side up, to keep the stencil plate spaced from a flat drawing surface below, this being a common precaution to prevent smearing if the drawing is done in ink through the stencil.

In order to make the use of the stencil still easier, a variety of arm positions is shown in at least one outline, so that some of these different may be indicated without rotation of the stencil.

Foreshortening of reach in the plane of the stencil in the cases of arm positions oblique to the horizontal plane is taken care of in the top view outline. Presentations are provided not only for a horizontally outstretched left arm 8, but also for positions respectively at 30°, 45°, and 60° to the horizontal, illustrated by the positions 9, 11, and 12 of the right arm.

In the case of the pivot point 3*j'* auxiliary holes 16 and 17 are provided to indicate the range of side-to-side rotation of the head with additional holes 26 and 27 provided to indicate the range of twisting the torso at the loins to rotate to the right and to the left.

The side view outline shows the head 15 in a normal position for a person standing erect in a workplace which may, for example, be in front of a counter. The arrow 25 indicates the normal direction of view in this position and a few holes are provided along the shaft of this arrow.

Holes 10, 20, 30 and 40 on one hand, and 50, 60 and 70 on the other, indicate the limits of the angle through which the line of sight may be swung by moving only the eyes.

As mentioned before a series of stencils such as the one illustrated in the FIGURE is preferably provided to represent the maximum, minimum and average sizes to be considered, of physical human bodies, all to the same scale. In this case it is conventional to regard dimensions of the average man as essentially the same as those for the largest normal woman, and likewise to combine the stencils for the smallest man and the average woman. When dealing with the inside dimensions of a workplace (for example, with leg room) it is the largest body that is important; whereas when dealing with outside dimensions (for example, the ability to see over a table or counter surface), the critical dimensions are to be obtained from the characteristics of the smallest body to be taken into account. In this connection the Jenik publication cited in the introduction above is particularly enlightening.

The stencil can, of course, be made by boring the holes and milling the slots in a plate, even with automatic machinery, but it will generally be convenient after having made a model to a desired scale to make stencils in quantity by injection molding or some similar casting process for reasons of economy.

Although the invention has been described with reference to a particular illustrative embodiment, it will be understood that modifications and variations may be made within the inventive concept.

We claim:

1. A stencil plate for showing on a drawing the contour and disposition, to a predetermined scale, of the human body in a variety of attitudes of the body, for facilitating the design of man-machine interface structures for control of a vehicle or machine, comprising a thin flat plate having at least one outline of one view of a human body with a succession of line slots through said plate along said outline so as to permit said outline to be drawn, except for short interruptions, through said slots, and having pivot holes respectively located at places within a said outline corresponding to joints of the body thereby represented, whereby outlines may be drawn at least in part for a variety of body postures in the same direction of view by rotating the stencil plate about a pivot hole between stages of tracing the body outline through the stencil, said at least one outline of one view of a human body being an outline of a view from above of a human body with an erect torso which view includes at least two outlines of an arm, in respectively different positions, connected to the same shoulder; an arm outline in at least one position for each shoulder ; and slots for showing the position of the knees in a seated attitude of the body.

2. A stencil plate as defined in claim 1 in which at least one outline is of an erect human body viewed horizontally and has associated therewith at least one pivot point hole located between neck and groin for representing the effect of flexure of the spine upon the body outline.

3. A stencil plate as defined in claim 2 in which in at least one outline of an erect human body viewed horizontally there are at least two outlines of arms in respectively different attitudes with respect to the torso.

4. A stencil plate as defined in claim 2, in which there are two said outlines of an erect human body viewed horizontally, of which one is a side view and another is a view perpendicular to a side view.

5. A stencil plate as defined in claim 4, in which said side view outline illustrates the head as normally held upturned while standing at a counter or work position, and in which holes are provided along the axis of sight corresponding to the head position and also along lines indicating the normal maximum deviation of sight direction corresponding to the movement of the eyes alone.

6. A stencil plate as defined in claim 1, in which arm outlines are provided in more than two positions, connected with the same shoulder, at least one of said more than two positions corresponding to the arm extending in the horizontal plane and at least one of said more than two positions corresponding to an arm extending at an angle of at least 30° to the horizontal plane.

7. A stencil plate as defined in claim 1, in which said outline of a human body viewed from above includes an outline slot for at least one side of the head and at least one pivot point for showing the effect of head rotation.

8. A stencil plate as defined in any of claims 1–5, 6 and 7, in which each said outline has at least one arm view with a side view of the hand, and at least one arm view with a view of the hand which is perpendicular to a side view thereof.

9. A stencil plate as defined in any of claims 1–5, 6 and 7, in which each said outline has at least one arm view with a side view of the hand, and at least one arm view with a view of the hand which is perpendicular to a side view thereof, and in which further the last-mentioned view of the hand includes a perforation in a position corresponding to the midpoint of the hand.

10. A stencil plate as defined in any of claims 1–5, 6 and 7, in which in the neighborhood of at least some of the pivot point holes, additional holes are provided for indicating the extent of maximum deviation from the position of the joint represented in the outline, which can be produced by flexure of the joint in a normal human body.

11. A stencil plate as defined in any of claims 1–5, 6 and 7, in which additional holes larger than said pivot point holes are provided for finger grips for rotation of the plate.

12. A stencil plate as defined in any of claims 1–5, 6 and 7, in which spacing knobs are provided on both sides of said plate, slightly spacing the stencil plate from an underlying flat surface, regardless of which side of the stencil plate is free.

* * * * *